United States Patent [19]

Howard

[11] Patent Number: 4,866,249

[45] Date of Patent: Sep. 12, 1989

[54] SAFETY DEVICE FOR HAIR CURLING HEATING IRONS TO PREVENT BURNS

[76] Inventor: Charles W. Howard, 4309 Morpheus Lane, Sacramento, Calif. 95864

[21] Appl. No.: 109,623

[22] Filed: Oct. 16, 1987

[51] Int. Cl.[4] ..... H05B 1/00; A45D 1/04; A45D 2/36

[52] U.S. Cl. ..... 219/225; 132/229; 132/231; 132/243; 219/230

[58] Field of Search ..... 219/222–226, 219/230; 132/7, 9, 11 R, 37 R, 37 A, 33 R, 31 R, 36 R, 118, 117, 85, 229, 231, 243

[56] References Cited

U.S. PATENT DOCUMENTS

| | | | |
|---|---|---|---|
| 3,660,634 | 5/1972 | Scott | 132/118 X |
| 3,814,113 | 6/1974 | Morane et al. | 132/36 R |
| 4,209,685 | 6/1980 | Walter et al. | 132/37 R |
| 4,257,434 | 3/1981 | Wahl | 132/33 R |
| 4,267,851 | 5/1981 | Plaisted | 132/33 R |
| 4,326,545 | 4/1982 | Motegi et al. | 132/33 R |
| 4,456,815 | 6/1984 | Andis | 132/9 |

FOREIGN PATENT DOCUMENTS

| | | | |
|---|---|---|---|
| 43907 | 1/1982 | European Pat. Off. | 219/225 |
| 46887 | 3/1982 | European Pat. Off. | 132/85 |
| 2827547 | 1/1980 | Fed. Rep. of Germany | 219/222 |
| 3000459 | 7/1981 | Fed. Rep. of Germany | 132/9 |

*Primary Examiner*—Anthony Bartis

*Attorney, Agent, or Firm*—Bloom & Kreten

[57] ABSTRACT

A hair styling curler including a handle supporting an electrically heated barrel and having a manually pivotal curling clamp is provided with a safety device for preventing burns. The safety device includes a plurality of spaced non-heat conductive ribs carried on the surface of the clamp remote from the barrel which are cooperate with corresponding plurality of radially extending non-heat conductive ribs carried on the outer surface of the barrel to define a plurality of spaced annuli completely circumscribing the barrel and which prevent contact of the heated barrel by the user yet allow hair contact with the heated barrel between adjacent annuli for imparting a curl thereto. The spaced ribs on the barrel are interconnected by tracks to form a unitary assembly which is mounted on the barrel by insertion of the tracks into complementary trackways formed on the outer surface of the barrel and accessible by a removable end cap on the barrel end distal from the handle.

27 Claims, 2 Drawing Sheets

SAFETY DEVICE FOR HAIR CURLING HEATING IRONS TO PREVENT BURNS

FIELD OF THE INVENTION

The following invention relates generally to a hair curler heating iron which has a safety device to prevent burns to the skin yet allows hair to be heated and curled safely. Burns from mishandling the heating iron have been prevented.

BACKGROUND OF THE INVENTION

Those skilled in the art of hair styling recognize that a curl can be imparted to a lock of hair by engaging the lock of hair with a source of heat and winding the lock about the heat source for a certain period of time. First, the lock of hair is extended radially from the scalp. The hair extremities are placed between the clamp and the heating iron. After scrolling the hair about the heating implement, for a predetermined amount of time and releasing, a wave is imparted into the hair fiber.

When this procedure is performed by an experienced stylist, the possibility of mishandling the heating iron is at a minimum since the operator has both hands and full attention directed towards the endeavor. It is known, however to provide home curling units where the consumer personally will manipulate the heating iron device. Should the consumer mishandle the heating iron, and since there is no insulation between the curling iron and the skin of the person handling the device, mismanagement of the device can lead to serious burns.

The following patents reflect the known prior art, but it is clear that none of these patents is directed to an instrumentality for precluding the possibility of serious burns should the curling iron engage a portion of the person other than the hair to be curled.

| | | |
|---|---|---|
| 4,368,376 | Andis | January 11, 1983 |
| 3,731,694 | Moro | May 8, 1973 |
| 3,922,521 | Visgel et al | November 25, 1975 |
| 1,549,130 | Fromager et al | August 11, 1925 |
| 1,605,540 | Gibney | November 2, 1926 |
| 4,163,143 | Federico et al | July 31, 1979 |

It is clear that none of these patents are concerned with avoiding the possibility of burning either the stylist using the curling iron or the patron whose hair is being curled. It is a likely and forseeable event the iron will slip because of entanglement with the hair or for other reasons.

SUMMARY OF THE INVENTION

It is important to note that the critical step for effectively imparting curl to hair is contacting hair strands with a source of heat. Any other consideration is ancillary to the curling process. While it is true that different "scrolling" techniques will modify the type of of the curl imparted into the hair, exotic scrolling techniques merely add to the difficulty in using curling irons both at home and professionally.

Protection from burns according to the instant invention takes the form of nonheat conductive rings which circumscribe the barrel of a curling iron. The rings are spaced along the length of the barrel stratigically so that hair can pass between adjacent rings to get the beneficial heat imparted thereto but one grasping the barrel or one touching the barrel with a portion of the skin will not come in contact with the heating element.

Some prior art devices include a plurality of bristles extending from the barrel of the curling iron which may incidentally preclude contact with the heating element. But the placement of these bristles is not sufficiently coextensive about the heating barrel so that contact with the heat in an unwanted manner may still occur. Moreover, the use of rings prevents entanglement of the hair when unwinding the hair from the heating barrel. It is noted that bristles promulgate hair entrainment and therefore exacerbate the problem of snags. This may cause one to lose grip upon the curling iron handle.

The heating barrel of the instant curling iron is provided with a plurality of longitudinally extending trackways exposed about the periphery of the heating barrel. These trackways are accessible by removal of a plug positioned at a terminus of the heating barrel remote from the handle. Access to these trackways along the periphery of the heating barrel allows an integrally formed series of rings to be slideably placed upon the heating barrel. Provision is made on an outer exposed surface to the barrel for a pivoting clamp which together with the barrel define a pair of jaws. The clamp allows exposure to a portion of the heating barrel not having rings carried thereon. Instead, an outer surface of the clamp which is not in contact with the heating barrel has a portion of the ring extending outwardly therefrom to provide complete protection around the heating barrel with the clamp.

OBJECTS OF THE INVENTION

Accordingly, it is a primary object of this invention to provide a new and useful hair curling device which precludes the possibility of burning the skin of the user.

A further object of this invention is to provide a device as characterized above which minimizes the possibility of entanglement with the curling iron which heretofor has been an aggravating condition not only with respect to effective hair curling per se, but also with respect to inducing mishandling of the curling iron, leading to burns of the skin.

A further object of this invention contemplates providing a device as characterized above which benefits from the economies of scale associated with mass production techniques.

A further object of this invention contemplates providing a device as characterized above which is durable in construction and safe to use.

A further object of this invention contemplates providing a device as characterized above which includes a plurality of non-heat conductive members emanating from a heating barrel of a curling iron which are spaced apart to allow hair to be engaged by the barrel of the heating element itself, but the non-heat conductive members preclude contact of the heating barrel with one's hands or skin. A series of nonheat conductive members are spaced along the length of a heating barrel. Adjacent non-conductive members preferrably interconnected by tracks which allow placement of these non-heat conductive members as a single unit on the heating barrel.

In addition, a primary object of this invention is to provide a device as characterized above in which a heating clamp associated with the curling iron includes a plurality of non-heat conductive members on an outer surface thereof to provide complete protection about the heating barrel to thereby prevent burns.

A further object of this invention contemplates providing a device as set forth hereinabove which provides an improved curling iron because the possibility of entanglement by the heating iron with respect to the hair has been minimized due to the absence of any bristles.

These and other objects will be made manifest when considering the following detailed specification taken in conjunction with the drawing figures.

DESCRIPTION OF THE DRAWING FIGURES

BRIEF DESCRIPTION OF THE PREFERRED EMBODIMENT

Figures 1, 2, 3, 4, 5:
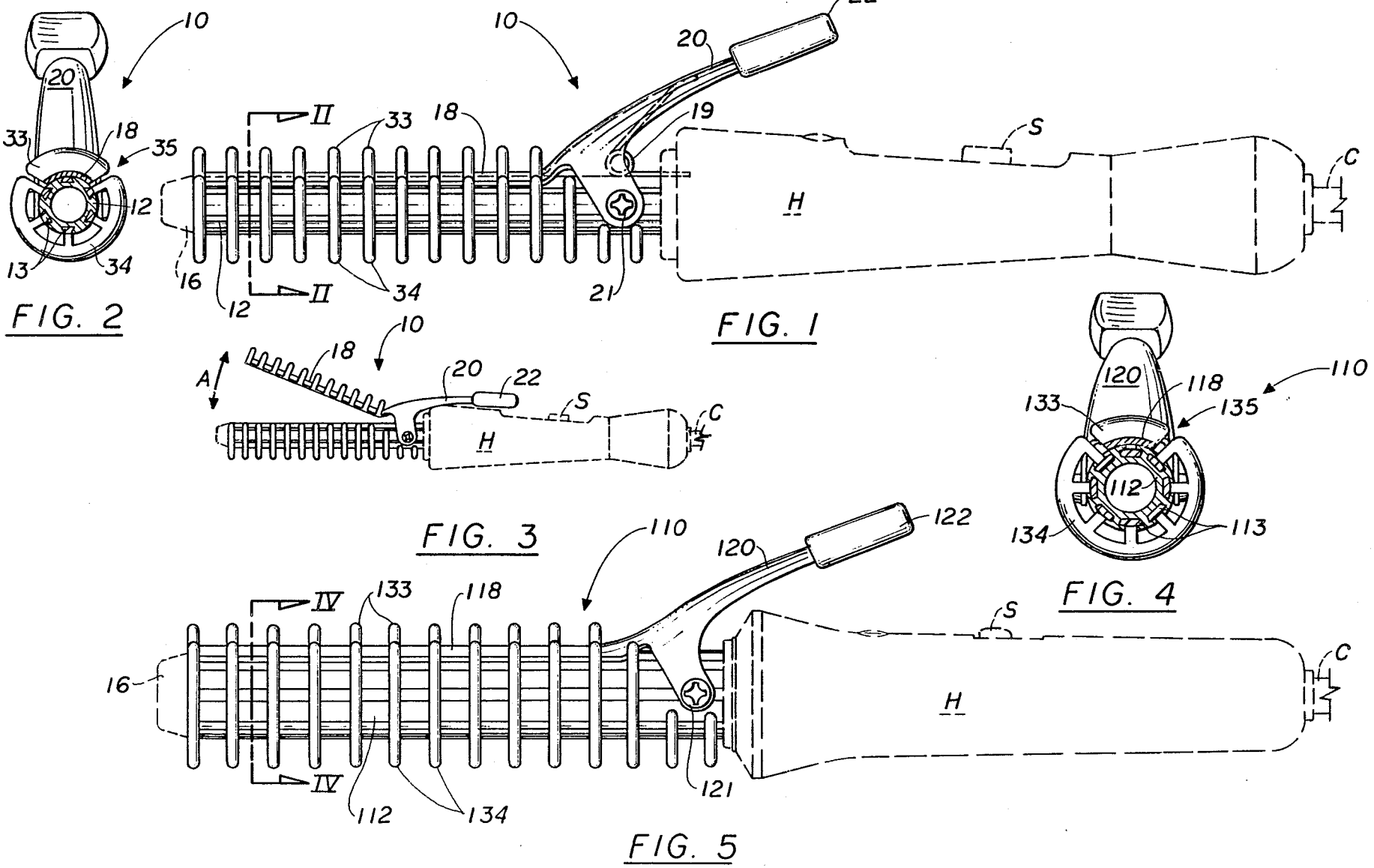
FIG. 1 is a side view of the hair styling device according to the present invention.
FIG. 2 is a sectional view taken along lines 2—2 of FIG. 1.
FIG. 3 shows the device of FIG. 1 with the clamp in an open position.
FIG. 4 is a sectional view taken along lines 4—4 of FIG. 5.
FIG. 5 is a side view similar to that which is shown in FIG. 1 illustrating a second form of the invention.

Referring to the drawings now, wherein like reference numerals refer to like parts throughout the various drawing figures, reference numeral 10 is directed to the hair styling safety device according to one from of the invention, and reference numeral 110 is directed to a second form of the invention.

Each hair styling device includes a handle H of conventional commercial manufacture, an on/off switch S for enabling a heatable barrel 12 (112) and an AC cord C which provides power for the device.

A terminal portion of the heatable barrel 12 (112) includes a plug 16 which is removeably attached thereto. Upon removal plug 16 exposes a trackway system as shown in figures 2 and 4. Specifically, a mortise type trackway 13 (FIG. 2) or a T shaped trackway 113 (FIG. 4) is provided along the outer periphery of the heatable barrel running along the longitudinal extent of the barrel for purposes to be assigned.

In addition, the hair styling device includes a clamp 18 which pivots from a first closed position as shown in FIGS. 1 and 5 to an open position as shown in FIG. 3 by moving the clamp 18 in the direction of the double ended arrow A. Each clamp 18, 118 is fixed to the heatable barrel 12, 112 by means of pivot 21, 121. A clamp lever 20, 120 extends on a side of the clamp along side the pivot 21, 121. A thumb tab 22, 122 is provided at a free end of the lever so that, against biasing form a spring 19, the clamp 18 can move as per FIG. 3 in the direction of the arrow A. The clamp is not heat conductive.

A top surface of each clamp 18, 118 is provided with a plurality of arcuate segments 33, 133 formed from non-heat conductive material and fixed to the outer arcuate surface of the clamp by means of adhesive or by being integrally formed therewith. Each arcuate segment 33, 133 is transverse to the longitudinal axis of the heatable barrel, which barrel is shown in the drawings as being substantially cylindrical. It is clear, however, that other configurations for the barrel are possible as are other configurations for segment 33, as will become evident.

Figure 7:
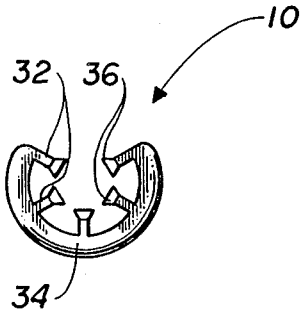
FIG. 7 is an end view of that which is shown in FIG. 6.
Figure 9:
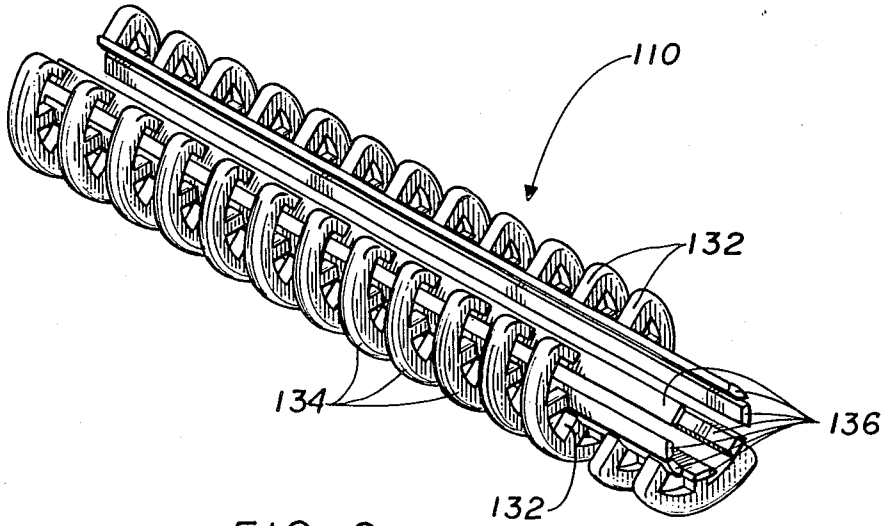
FIG. 9 is a perspective view of a second form of the invention, similar to FIG. 6.
Figure 6:
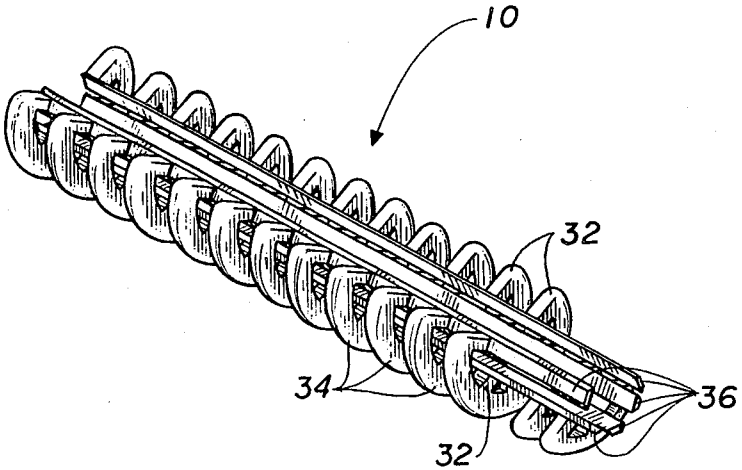
FIG. 6 is a perspective view of one element according to the present invention according to that which is shown in FIG. 1.
Figure 8:
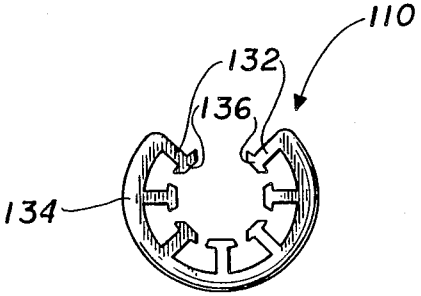
FIG. 8 is an end view of that which is shown in FIG. 9.

The trackway 13, 113 is provided with a safety device which renders it extremely unlikely that a heating iron such as the one described can impart a burn to the user. In addition, entanglement of the heating device with hair is much less likely than with the known prior art. With respect to FIGS. 6 through 9, the trackways receive a plurality of tracks 36, 136 having an outer contour complimental to the configuration of the trackway 13, 113. Thus, the mortise shaped trackway 13 will receive a tenon shaped track 36 for a dovetail type interlocking arrangement, or the T shaped recess 113 will have a complimentary formed T shaped track 136 for similar purposes. Details of the tracks 36, 136 are shown in FIGS. 7 and 8. More particularly, the tracks are detailed to show that the ends which ride within the trackway 13, 113 have a configuration complimental to the contour of the trackways and have radially extending legs 32, 132 which terminate in a ring segment 34, 134 forming a major portion of an arc of a circle. A plurality of these rings are disposed along the length of the track 36, 136 so that the ring segments circumscribe a major portion of the heatable barrel 12 along its entire length. Attention is directed to figures 1 and 5 which show arcuate segments 34, 134 below the pivot 21, 121 which completes the protection along a bottom surface of the hair styling safety device. The lesser dimension of these segments provide clearance for the pivot 21, 121.

As shown in FIGS. 2 and 4, the top surface of each clamp is provided with further arcuate segments 33, 133 fixed to a top surface of clamps 18, 118 so that any portion of the heatable barrel 12 can be grasped without direct contact to the hot portion of the heating barrel. It is to be noted that the clamp lever 20, 120 is not heat conductive.

In use and operation, the styling device is manipulated to an open position as shown in FIG. 3 so that a lock of hair can be placed between the clamp 18 and the barrel 12 and heat can be imparted to the hair. The hair is wound upon the styling device once the clamp has been released to assume the FIG. 5 position. The presence each of arcuate segment and ring segment define an annulas circumscribing the barrel which facilitates winding the hair about the barrel between the interstices defined by adjacent ring and arcuate segment pieces. This precludes entanglement of the hair and minimizes the possibility of a person getting burned should the person manipulating the device lose grip on the handle, or if the heated rod gets too close to the skin of the person whose hair is being curled causing the heating iron to engage the hand, neck or face area of the person whose hair is being curled.

Moreover, having thus described the invention it should be apparent that numerous structural adaptations and modifications may be resorted to without departing from the scope and fair meaning of the claims setforth hereinbelow.

I claim:

1. A styling hair curler comprising in combination:

a handle supporting a heated barrel, a clamp pivotally attached to the barrel, said clamp being openable to receive hair between the barrel and said clamp for curling hair, a plurality of spaced non-heat conductive means carried on said clamp on a surface thereof remote from the barrel whereby said clamp will not burn user.

2. The curler of claim 1 wherein said barrel includes a plurality of radially extending non-heat conductive ribs carried on an outer surface of said barrel, each said rib spaced one from the other and aligned with said non-heat conductive means carried on said clamp so that a plurality of spaces are provided between adjacent, and said non-heat conductive means are conductive means continuous with said ribs to preclude burns by a user of the hair curler.

3. A device for preventing burns when using a curling iron for hair wherein the iron has a heatable barrel comprising, in combination:

a plurality of annuli adapted to circumscribe the barrel of the curling iron and adapted to be spaced along its longitudinal extent, said annuli formed from non-heat conducting material with each said annulus spaced from an adjacent annulus and adapted to preclude contact of the barrel by the user, yet adapted to allow hair contact with the barrel between adjacent annuli for imparting a curl thereto, wherein said plurality of annuli are each interconnected by means of longitudinally extending tracks adapted to be disposed about the outer periphery of the barrel and slideably constrained therewithin, wherein a plurality of legs extend from each track to said annuli and are adapted to space said annuli away from the heatable barrel a wherein said annuli have an interrupted circumferential portion, and whereupon the interrupted portion of each of the annuli being in axial alignment to provide a longitudinal gap adapted to receive a pivoted hair clamp associated with the barrel of the curling iron.

4. The device of claim 3 including a hair clamp adapted to be pivotally associated with the barrel of the curling iron and having an arcuate top surface upon which a plurality of spaced non-heat conductive arcuate segments is integrally formed and which are adapted to cooperate with said plurality of annuli to completely circumscribe the barrel.

5. The device of claim 3 wherein said tracks are substantially tenon shaped.

6. The device of claim 3 wherein said tracks are substantially "T" shaped in configuration.

7. A device for preventing burns when using a curling iron for hair wherein the iron has a heatable barrel comprising, in combination:

a plurality of annuli adapted to circumscribe the barrel of the curling iron and adapted to be spaced along its longitudinal extent, said annuli formed from non-heat conducting material a with each said annulus spaced from an adjacent annulus and adapted to preclude contact of the barrel by the user, yet adapted to allow hair contact with the barrel between adjacent annuli for imparting a curl thereto, wherein said annuli have an interrupted circumferential portion, and means for maintaining said interrupted portion of each of the annuli in axial alignment to provide a longitudinal gap adapted to receive a pivoted hair clamp associated with the barrel of the curling iron.

8. The device of claim 7, wherein said means for maintaining said interrupted portions of each of said plurality of annuli comprises longitudinally extending tracks interconnecting the annuli and adapted to be disposed about the outer periphery of the barrel and slideably constrained therewithin.

9. The device of claim 8 wherein a plurality of legs extend from each track to said annuli and are adapted to space said annuli away from the heatable barrel.

10. The device of claim 8 wherein said tracks are substantially tenon shaped.

11. The device of claim 8 wherein said tracks are substantially "T" shaped in configuration.

12. The device of claim 7, including a hair clamp adapted to be pivotally associated with the barrel of the curling iron and having an arcuate top surface upon which a plurality of spaced non-heat conductive arcuate segments is integrally formed and which are adapted to cooperate with said plurality of annuli to completely circumscribe the barrel.

13. A device for preventing burns when using a curling iron for hair wherein the iron has a heatable barrel comprising, in combination:

a plurality of annuli adapted to circumscribe the barrel of the curling iron and adapted to be spaced along its longitudinal extent and held in fixed position, said annuli formed from non-heat conducting material with each said annulus spaced from an adjacent annulus and adapted to preclude contact of the barrel by the user, yet adapted to allow hair contact with the barrel between adjacent annuli for imparting a curl thereto, said annuli each having a smooth outer periphery devoid of any bristles or comb-like tines, each said annulus adapted to be supported solely by contact with the barrel through legs extending from each said annulus.

14. The device of claim 13 wherein said plurality of annuli are each interconnected by means of longitudinally extending tracks connecting with said legs and adapted to be disposed about the outer periphery of the barrel and slideably constrained therewithin.

15. The device of claim 14 wherein a plurality of said legs extend radially from each track to said annuli and are adapted to space said annuli away from the heatable barrel.

16. The device of claim 15 wherein said tracks are substantially tenon shaped.

17. The device of claim 15 wherein said tracks are substantially "T" shaped in configuration.

18. The device of claim 13 wherein said annuli have an interrupted circumferential portion, the interrupted portion of each of the annuli being in axial alignment to provide a longitudinal gap adapted to receive a pivoted hair clamp associated with the barrel of the curling iron.

19. The device of claim 18, including a hair clamp adapted to be pivotally associated with the barrel of the curling iron and having an arcuate top surface upon which a plurality of arcuate segments are integrally formed and which are adapted to cooperate with said plurality of annuli to completely circumscribe the barrel.

20. A hairstyling device, comprising in combination:

a handle having an elongated heatable barrel extending from one end thereof, a plurality of circumferentially spaced trackways on the barrel and extending from the handle, longitudinally along the barrel, track means inserted in said trackways, said track means supporting burn protection means about said barrel to preclude burns by the device user, wherein said hairstyling device has said trackways each configured as a substantially mortise shaped recess and said track means supporting said burn protection means are formed as tenons to be received within said trackways, wherein said burn protection means is configured as a plurality of radially extending spaced non-heat conductive ribs circumscribing said heatable barrel for precluding direct contact by a user with the heatable barrel yet allowing hair to be placed in between adjacent ribs for heat contact with the barrel, wherein ech rib of said burn protection means has a rib interruption, said rib interruptions being axially aligned to provide means through which a non-conductive clamp pivotally attached to the curling iron may engage the barrel, said clamp including a pivoting lever for manipulation of said clamp from an open to a closed position, and said clamp having an arcuate outer surface provided with spaced non-heat conductive ribs which when considered collectively with ribs on said barrel define a complete series of annuli spaced along a longitudinal aspect of said barrel.

21. A hairstyling device, comprising in combination:

a handle having an elongated heatable barrel extending from one end thereof, a plurality of circumferentially spaced trackways on the barrel and extending from the handle, longitudinally along the barrel, track means inserted in said trackways, said track means supporting burn protection means about said barrel to preclude burns by the device user, wherein said track means are substantially "T" shaped in configuration and said trackways are configured as a "T" shaped recess for slidable reception therein of said "T" shaped track means, wherein said burn protection means includes a plurality of radially extending non-heat conducting ribs carried by said track means and, each said rib spaced one from the other and aligned with non-heat conductive spaced ribs carried on a clamp pivotally connected to an area adjacent where the handle and barrel interconnect so that a plurality of aligned spaces are provided between adjacent non-heat conductive ribs of both said barrel and said clamp to preclude burns by a user of the hair curler.

22. The device of claim 21 wherein said ribs carried on said trackways formed on said barrel are supported thereon by said track means having tracks integrally formed with said ribs and separated from said ribs by a radially extending legs, said tracks slideably received into said barrel trackways.

23. The device of claim 22 wherein said trackways are exposed for slideable insertion of said tracks therewithin by removal of a cap positioned on a distal extremely of said heatable barrel remote from the handle.

24. A hairstyling device, comprising in combination:

a handle having an elongated heatable barrel extending from one end thereof, a plurality of circumferentially spaced trackways on the barrel and extending from the handle, longitudinally along the barrel, track means inserted in said trackways, said track means supporting first non-heat conductive burn protection means about said barrel to preclude burns by the device user, wherein said burn protection means has an interrupted portion through which a non-heat conductive clamp pivotally attached to the curling iron may engage the barrel, said clamp includes a pivoting lever for manipulation of said clamp from an open to a closed position, and said clamp has an arcuate outer surface provided with second non-heat conductive burn protection means which when considered collectively with said first non-heat conductive burn protection means on said barrel define a complete series of annuli spaced along a longitudinal aspect of said barrel and said clamp.

25. The device of claim 24 wherein said hairstyling device has said trackways each configured as a substantially mortise shaped recess and said track means supporting said burn protection means are formed as tenons to be received within said trackways.

26. The device of claim 25 wherein said first and second burn protection means are collectively configured as a plurality of radially extending spaced ribs circumscribing both said heatable barrel and clamp yet allowing hair to be placed in between adjacent ribs for heat contact with the barrel.

27. The device of claim 24 wherein said track means are substantially "T" shaped in configuration and said trackways are configured as a "T" shaped recess for slideable reception therein of said "T" shaped track means.

* * * * *